US006431160B1

(12) United States Patent
Sugiyama et al.

(10) Patent No.: US 6,431,160 B1
(45) Date of Patent: Aug. 13, 2002

(54) AIR-FUEL RATIO CONTROL APPARATUS FOR AN INTERNAL COMBUSTION ENGINE AND A CONTROL METHOD OF THE AIR-FUEL RATIO CONTROL APPARATUS

(75) Inventors: Takayuki Sugiyama; Shin Adachi, both of Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 9 days.

(21) Appl. No.: 09/670,020

(22) Filed: Sep. 26, 2000

(30) Foreign Application Priority Data

Oct. 7, 1999 (JP) ..... 11-287143

(51) Int. Cl.[7] ..... F02D 41/00
(52) U.S. Cl. ..... 123/674; 123/480
(58) Field of Search ..... 123/674, 672, 123/675, 480, 486

(56) References Cited

U.S. PATENT DOCUMENTS

| | | | | |
|---|---|---|---|---|
| 4,870,938 A | * | 10/1989 | Nakaniwa | 123/489 |
| 5,099,817 A | * | 3/1992 | Nakaniwa | 123/489 |
| 5,181,499 A | * | 1/1993 | Kayanuma | 123/690 |
| 5,243,951 A | * | 9/1993 | Nakaniwa | 123/474 |
| 5,251,437 A | * | 10/1993 | Furuya | 123/674 |
| 5,598,702 A | * | 2/1997 | Uchikawa | 123/674 |
| 5,638,800 A | * | 6/1997 | Furuya et al. | 123/674 |
| 6,182,647 B1 | * | 2/2001 | Hori et al. | 123/674 |

FOREIGN PATENT DOCUMENTS

JP 04279748 A 10/1992

JP 07127507 A 5/1995

OTHER PUBLICATIONS

Collected Example of Automobile Engineering No. 95111, Nov. 4, 1994.

Technical Publications published by Japan Institute of Invention and Innovation No. 95–10939, Jul. 17, 1995.

* cited by examiner

*Primary Examiner*—Willis R. Wolfe
*Assistant Examiner*—Mahmoud Gimie
(74) *Attorney, Agent, or Firm*—Oliff & Berridge, PLC

(57) ABSTRACT

An air-fuel ratio control apparatus for an internal combustion engine has an oxygen sensor, a first operational means, a second operational means, a maximum and minimum setting means, an air-fuel ratio correcting means, a maximum and minimum magnifying means, and a maximum and a minimum returning means. When an air-fuel ratio learning value calculated by the second operational means reaches a maximum or minimum limit set by the maximum and minimum setting means, an air-fuel ratio feedback correction value is measured for a predetermined time. The maximum and minimum magnifying means increases the maximum or decreases the minimum limit of the air-fuel learning value in response to a deviation of fuel injection amount from a fuel injection amount requested for maintaining a target air-fuel ratio. The maximum and minimum returning means returns the maximum or minimum limit of the air-fuel ratio learning value to a predetermined basic maximum or minimum limit, when a predetermined condition continues for a predetermined time. An emission condition, or an emission amount exhausted from the internal combustion engine, is improved by the above-mentioned control.

17 Claims, 12 Drawing Sheets

AIR-FUEL RATIO CONTROL APPARATUS FOR AN INTERNAL COMBUSTION ENGINE AND A CONTROL METHOD OF THE AIR-FUEL RATIO CONTROL APPARATUS

FIELD OF THE INVENTION

The present invention relates to an air-fuel ratio control apparatus for an internal combustion engine and a control method of the air-fuel ratio control apparatus. The apparatus detects the air-fuel ratio of the internal combustion engine and corrects a fuel injection amount when the fuel injection amount deviates from a fuel injection amount requested for maintaining a target air-fuel ratio.

BACKGROUND OF THE INVENTION

Collected Examples Of Automobile Engineering No. 95111 (date of issue: Feb. 10, 1995 by Intellectual Property Subcommittee of Japan Automobile Manufacturers Association ) discloses an air-fuel ratio control apparatus. In this example, a maximum limit of an air-fuel ratio learning value KG is increased from +20% to +40%, and a minimum limit of the air-fuel ratio learning value is decreased from −20% to −40%, so that the absolute value of an air-fuel ratio feedback correction value FAF is less. The air-fuel ratio learning value and the air-fuel ratio feedback correction value are values for correcting a fuel injection amount for maintaining the air-fuel ratio of an internal combustion engine at a predetermined value (=a target air-fuel ratio). Increasing the maximum limit or decreasing the minimum limit prevents an emission amount in gas exhausted from the internal combustion engine from increasing when a feedback control is in an open condition. The aforementioned emission indicates for example CO, HC, NOx, or etc.

The above-mentioned control is explained in detail using FIG. 8. FIG. 8 is a flowchart showing a routine in which the air-fuel ratio learning value KG is calculated in an air-fuel control apparatus of an internal combustion engine.

The routine shown in FIG. 8 begins at S1 (S1 indicates step 1, and hereinafter the same expression as this is used.) In S1, ±20% is set to a maximum or minimum limit of the air-fuel ratio learning value KG. In next query step, whether a deviation of the fuel injection amount reaches a predetermined abnormal level or not is determined by a detection of a fuel system by an OBD (On Board Diagnosis). That is, whether a condition of |fafkgd|>35% continues for 9 seconds or more is determined in S2. Here, |fafkgd| is a fuel injection correction value (the air-fuel ratio feedback correction value FAF+the air-fuel ratio learning value KG) and corresponds to a value which is approximately equal to a deviation of the fuel injection amount from the fuel injection amount requested for maintaining the target air-fuel ratio. On the other hand, 35% is an abnormal level. When "yes" is determined, the routine transitions to S3. ±40% is set as the maximum or minimum limit of the air-fuel ratio learning value KG in S3. The calculating routine of the air-fuel ratio learning value KG then ends. When "no" is determined in S2, the control returns to SI.

According to the above-mentioned example, the emission amount before the deviation of the fuel injection amount reaches the abnormal level is greater than the emission amount after the fuel injection amount reaches the abnormal level, though the deviation of the fuel injection amount before it reaches the abnormal level is smaller than the deviation after it reaches the abnormal level. The above-mentioned contradiction is caused by increasing the maximum limit and decreasing the minimum limit of the air-fuel ratio learning value KG. The maximum and minimum limits of the air-fuel ratio learning value KG are drastically changed from ±20% to ±40% when crossing the border of the abnormal detection level, as shown in FIG. 9. When the emission amount crosses over an emission regulated value× 1.5 line in FIG. 9, MIL (Malfunction Indicator Light) is turned on and the disorder condition is cautioned.

FIG. 10 shows a condition in which a deviation of the fuel injection amount crosses over −40%. When a fuel injection correction value (FAF+KG) reaches the abnormal level, for example −35% as illustrated by (1) in FIG. 10, the maximum and minimum limits of the air-fuel ratio learning value KG are respectively increased and decreased from the normal value, for example ±20%, to a changed value for example ±40% as shown by (2). The air-fuel ratio feedback correction value FAF is, then, released from the restriction of maximum and minimum limits of the air-fuel ratio feedback correction value, ex. ±20%. This means that the line of the FAF is not on the straight line of −20% after the maximum and minimum limits are changed, as shown by (3) in FIG. 10. After the deviation of the actual fuel injection amount is measured and confirmed, it is determined in the next trip as shown by (4) in FIG. 10 that the fuel system is abnormal.

When the fuel injection correction value (FAF+KG) does not reach the abnormal level ±35% and for example the fuel injection correction value (FAF±KG) is ±30%, an uncorrectable deviation 10% (=30%−20%) which can not be corrected by the air-fuel ratio learning value KG is corrected by the air-fuel ratio feedback correction value FAF. This condition is shown in FIG. 11. FIG. 11 shows a condition where the fuel injection correction value is −30%. In this case, a problem, namely an amount of the emission (CO, HC, NOx, or etc.) from the internal combustion engine is more, occurs, because a deviation 10% (=30%−20%) can not be corrected by the air-fuel ratio learning value KG and an injection mixed by air and fuel is too rich (indicates that the fuel amount is more than required fuel amount) in a low coolant temperature or after the fuel injection is cut in decelerating driving. In this condition a feedback control is open, and the air-fuel ratio feedback correction value FAF is ±0%. That is, when the fuel injection correction value is less than or close to the abnormal level, the amount of emission such as CO, HC, NOx, or etc. is more than the emission amount which is exhausted when the fuel injection correction value is over the abnormal level.

SUMMARY OF THE INVENTION

It is thus one object of the present invention to solve the aforementioned problems. That is, the object of the invention is to provide an air-fuel ratio control apparatus for an internal combustion engine which in steps increases a maximum limit or decreases a minimum limit of an air-fuel ratio learning value in response to a deviation of a fuel injection amount from a fuel injection amount requested for maintaining a target air-fuel ratio. Another object of the invention is to provide a control method of the above-mentioned air-fuel control apparatus.

An apparatus for controlling an air-fuel ratio in an internal combustion engine comprises an oxygen sensor, a first operational means, a second operational means, a maximum and minimum setting means, an air-fuel ratio correcting means, a maximum and minimum magnifying means, and a maximum and minimum returning means. The oxygen sensor is in an exhaust passage of the internal combustion engine and detects a concentration of oxygen in exhaust gas from the internal combustion engine. The first operational means calculates an air-fuel ratio feedback correction value based on a value outputted by the oxygen sensor so that an actual air-fuel ratio in the internal combustion engine is equal to a target air-fuel ratio. The second operational means calculates an air-fuel ratio learning value so that the air-fuel ratio feedback correction value is within a predetermined range. The air-fuel ratio learning value is different from the air-fuel ratio feedback correction value. The maximum and minimum setting means sets a maximum limit and a minimum limit of the air-fuel ratio learning value. The air-fuel ratio correcting means corrects a fuel injection time of a fuel injection valve based on the air-fuel ratio feedback correction value calculated by the first operational means and the air-fuel ratio learning value calculated by the second operational means. The maximum and minimum magnifying means increases the maximum limit or decreases the minimum limit of the air-fuel ratio learning value by stepping degrees in response to a deviation of fuel injection amount from a fuel injection amount requested for maintaining the target air-fuel ratio after the air-fuel ratio learning value reaches the maximum or minimum limit. In this operation, the above description includes the step of increasing the maximum limit and decreasing the minimum limit or exclusively increasing the maximum or exclusively decreasing the minimum. Incidentally, the fuel injection amount is injected by the fuel injection valve deposited in an intake passage of the internal combustion engine. The maximum and minimum returning means returns the maximum or minimum limit of the air-fuel ratio learning value changed by the maximum and minimum magnifying means to a predetermined basic maximum or minimum limit of the air-fuel ratio learning value.

Since the maximum limit of the air-fuel ratio learning value is increased or the minimum limit of the air-fuel ratio learning value is decreased in response to the deviation of fuel injection amount from the fuel injection amount requested for maintaining the target air-fuel ratio, the air-fuel feedback correction value can be very small or near 0. Consequently, an emission (for example, CO, HC, NOX, or etc.) amount can be restrained smoothly without any irregular point. Furthermore, since the maximum or minimum limit of the air-fuel ratio learning value changed by the maximum and minimum magnifying means is returned to the predetermined basic maximum or minimum limit of the air-fuel ratio learning value, temporary increasing or decreasing the limit of the air-fuel ratio learning value due to a temporary occurrence of the deviation of the fuel injection amount can be restrained. Consequently, a rough control of the air-fuel ratio can be avoided.

BRIEF DESCRIPTION OF THE DRAWINGS

The above and other objects, features, advantages, and technical and industrial significance of this invention will be better understood by reading the following detailed description of a presently preferred embodiment of the invention, when considered in connection with the accompanying drawing, in which.

DETAILED DESCRIPTION OF PREFERRED EMBODIMENTS

Figure 1:
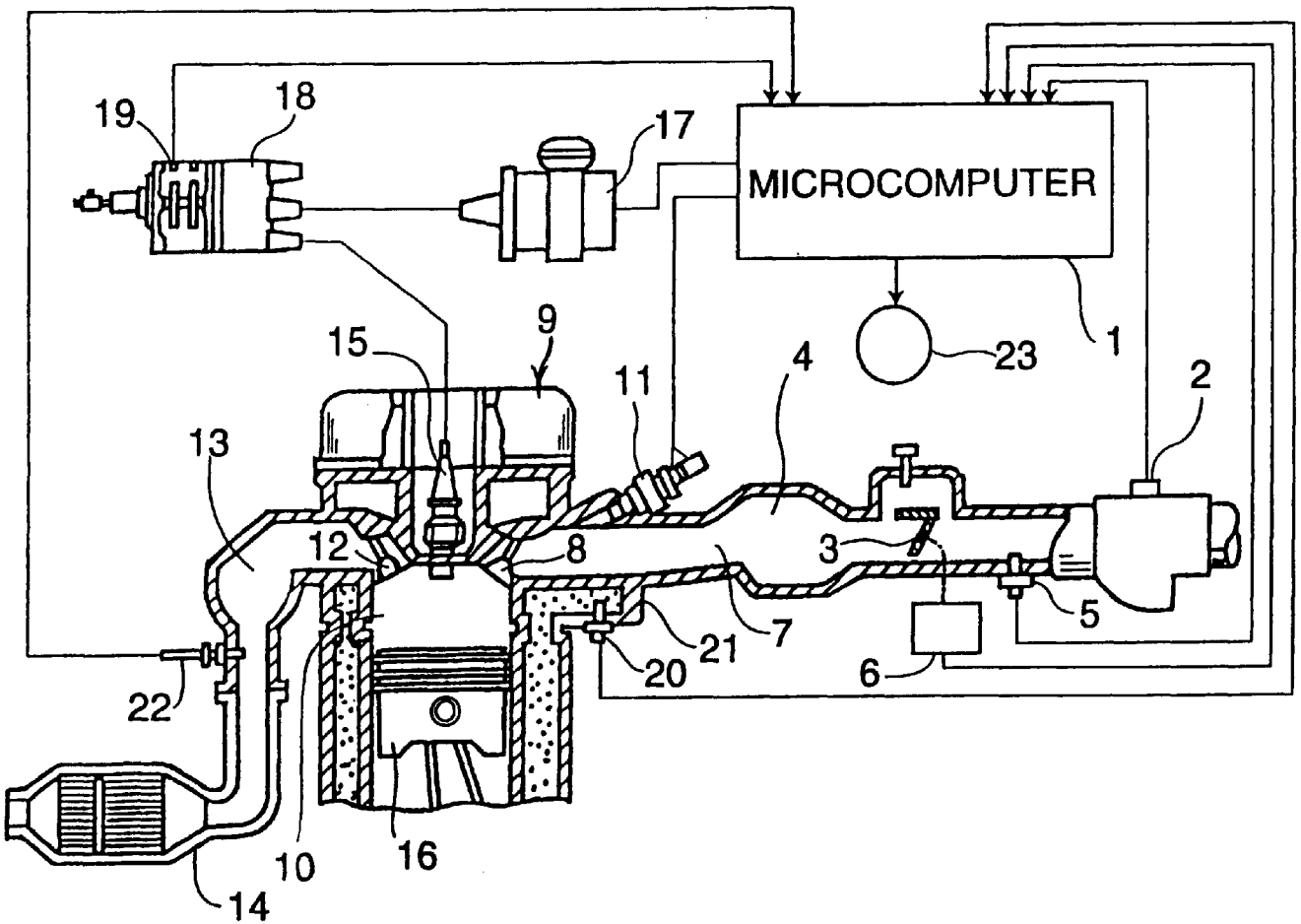
FIG. 1 shows a system of an air-fuel ratio control apparatus for an internal combustion engine 9 as a first embodiment of the present invention.

In the following description and the accompanying drawings, the present invention will be described in more detail in terms of specific embodiments. First, FIG. 1 is a system structure showing an air-fuel ratio control apparatus for an internal combustion engine as a first embodiment of the present invention. This embodiment is adopted to a four-cylinder and four-cycle spark ignition type internal combustion engine 9. The internal combustion engine 9 is controlled by a microcomputer 1.

A surge tank 4 is deposited downstream of an air flow meter 2, and a throttle valve 3 is between the surge tank 4 and the air flow meter 2. An intake air temperature sensor 5 which detects a temperature of an intake air is provided near the air flow meter 2. An idle switch 6 is attached to the throttle valve 3. The idle switch 6 is turned on when the throttle valve 3 is full-closed.

The surge tank 4 is connected to a combustion chamber 10 of the internal combustion engine 9 by way of an intake passage 7 and an intake valve 8. A fuel injection valve 11 is partially projected into the intake passage 7 in each cylinder of the internal combustion engine 9. Fuel is injected into air flowing in the intake passage 7.

The combustion chamber 10 is connected to a catalyst 14 by way of an exhaust valve 12 and an exhaust passage 13. An ignition plug 15 is provided partially protruding into the combustion chamber 10. A piston 16 moves up-and-down in a reciprocating motion in FIG. 1.

An igniter 17 generates high voltage, and the high voltage is distributed to the ignition plug 15 deposited on each cylinder by a distributor 18. A rotation angle sensor 19 detects a crank angle from a rotating angle of a shaft of the distributor 18. For example, the rotation angle sensor 19 outputs a crank angle signal of the internal combustion engine 9 at each 10 degrees of CA (=Crank Angle) and sends the signal to the microcomputer 1.

A coolant temperature sensor 20 is provided, penetrating through an engine block 21, and the end of the coolant temperature sensor 20 protrudes in a water jacket in the internal combustion engine 9. The sensor 20 detects coolant temperature of the engine 9 and outputs a signal of the coolant temperature. An oxygen sensor (also called $O_2$ sensor) 22 which detects a concentration of oxygen gas contained in exhaust gas of the internal combustion engine 9 is deposited in the exhaust passage 13, and the end of the oxygen sensor 22 penetrates and protrudes into the exhaust passage 13. A warning light 23 is connected to the microcomputer 1. The warning light 23 is turned on when the fuel injection system has something wrong and notifies a driver of a vehicle with the engine 9 (shown in FIG. 12) of an abnormality of the fuel injection system.

Figure 2:
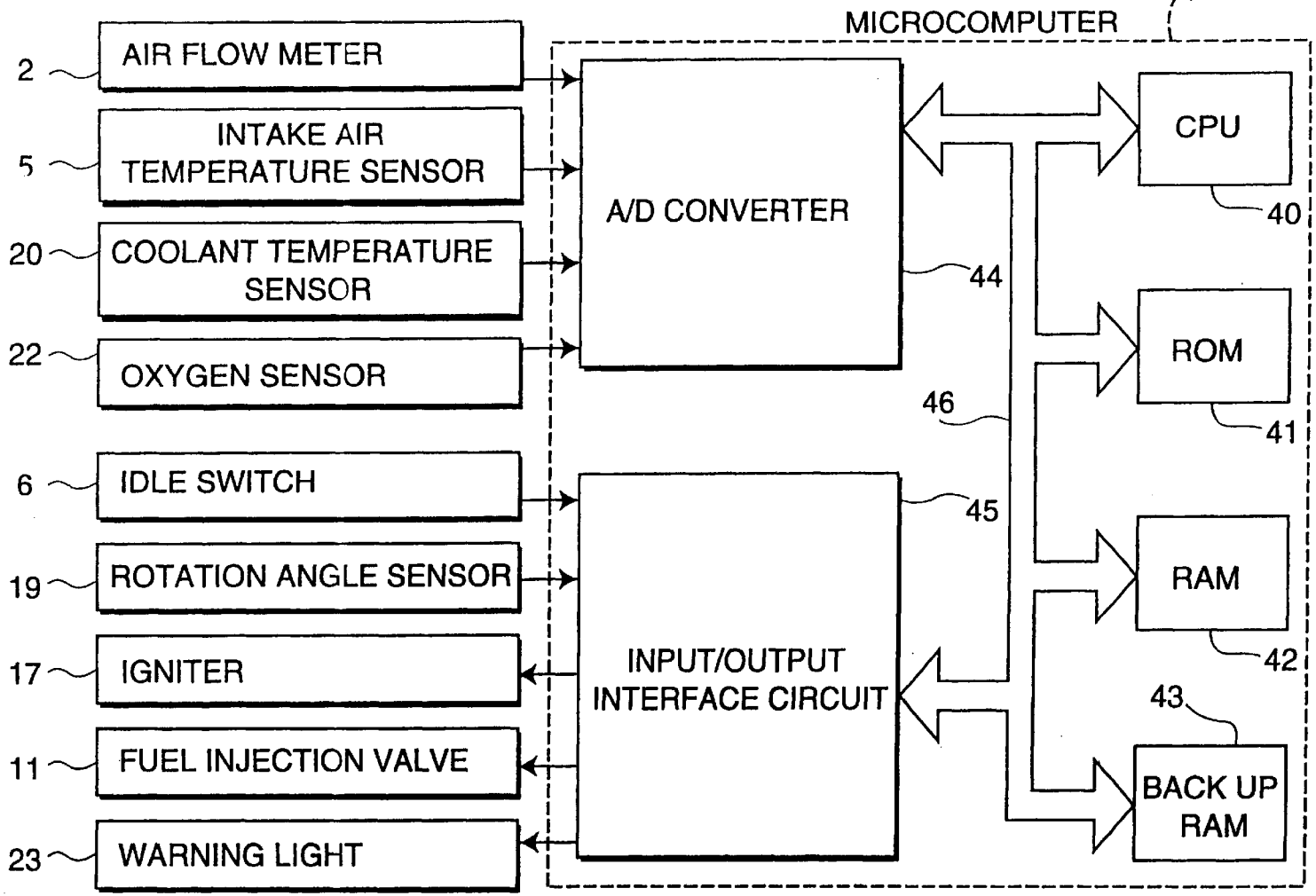
FIG. 2 shows a hardware structure of the microcomputer 1 shown in FIG. 1 and a block diagram showing a relationship between the microcomputer 1 and sensors which send signals to the microcomputer 1, parts to which the microcomputer 1 sends signals, or etc.

The microcomputer 1 shown in FIG. 1 has such a hardware structure as shown in FIG. 2. The same parts in FIG. 1 and FIG. 2 are given the same numbers, and the overlapping explanation is here omitted.

In FIG. 2, the microcomputer 1 comprises a CPU (Central Processing Unit) 40, a ROM (Read Only Memory) 41 which contains a processing program, a RAM (Random Access Memory) 42 which is used as an operating area, a Backup-RAM 43 which holds data after the internal combustion engine 9 stops, an AID converter 44, an I/O (Input/Output) Interface Circuit 45, etc. They are connected together by a bus 46.

The A/D converter 44 in order inputs a signal of an intake air amount from the air flow meter 2, a signal of intake air temperature from the intake temperature sensor 5, a signal of coolant temperature from the coolant temperature sensor 20, and a signal of oxygen concentration from the oxygen sensor 22. The A/D converter 44 converts from analog data to digital data and in order sends signals to the bus 46.

The I/O interface circuit 45 inputs a detected signal from the idle switch 6 and a signal of revolutions from the rotation angle sensor 19 and sends signals to the CPU 40 by way of the bus 46. On the other hand, the FD interface circuit 45 inputs each signal from the bus 46 and sends it to the fuel injection valve 11, the igniter 17, or the warning light 23. An interval of the fuel injection from the fuel injection valve 11 is then controlled. When the signal indicating the ignition from the igniter 17 is inputted, primary electric current of an ignition coil is cut off and the ignition plug 15 is ignited.

The above-mentioned microcomputer 1 executes procedures shown in steps of the flowchart which is described later, according to a program contained in the ROM 41.

Figure 3:
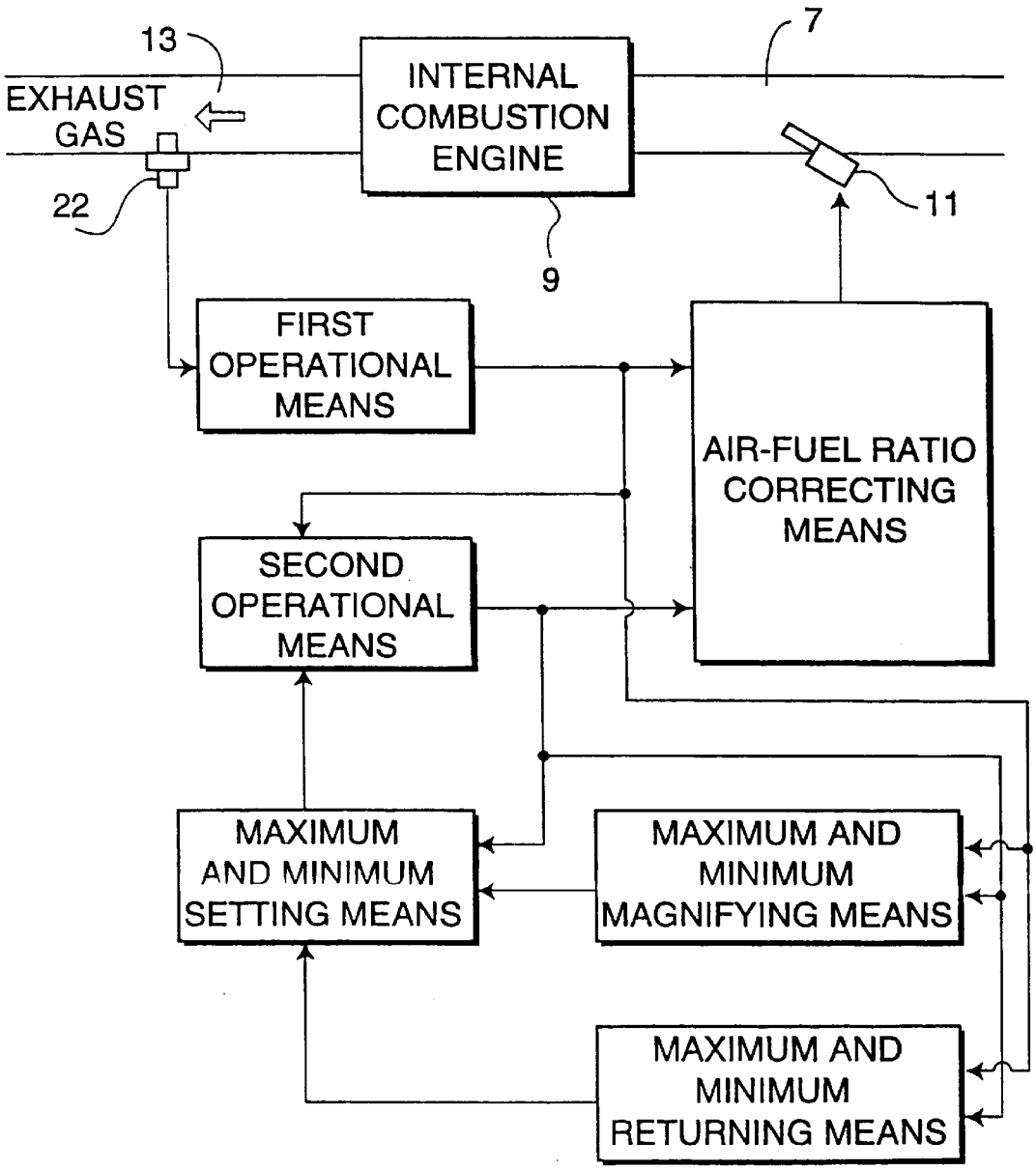
FIG. 3 is a block diagram showing a basic structure of the present invention.

Next, a basic structure of the present invention is explained using FIG. 3, which is a block diagram of the basic structure. In FIG. 3, the internal combustion engine 9 which comprises the oxygen sensor 22, the fuel injection valve 11, a first operational means, a second operational means, an air-fuel ratio correcting means, a maximum and minimum setting means, a maximum and minimum magnifying means, and a maximum and minimum returning means is illustrated. The first operational means calculates an air-fuel ratio feedback correction value FAF on the basis of an outputted value by the oxygen sensor 22, so that an actual air-fuel ratio is equal to a target air-fuel ratio. The second operational means calculates an air-fuel ratio learning value KG, so that the air-fuel ratio feedback correction value FAF is within a predetermined range. The air-fuel ratio learning value KG is different from the air-fuel ratio feedback correction value FAF. The air-fuel ratio correction means corrects a fuel injection time of the fuel injection valve 11 which is deposited in the intake passage 7 of the engine 9, based on the air-fuel ratio feedback correction value FAF calculated by the first operational means and the air-fuel ratio learning value KG calculated by the second operational means. The maximum and minimum setting means sets a maximum limit and a minimum limit of the air-fuel ratio learning value KG. The maximum and minimum magnifying means increases the maximum or decreases the minimum limit of the air-fuel ratio learning value KG by stepping degrees in response to a deviation of fuel injection amount, injected by the fuel injection valve, from a fuel injection amount requested for maintaining the target air-fuel ratio, after the air-fuel ratio learning value KG reaches the maximum or minimum limit. The maximum and minimum returning means returns the maximum or minimum limit of the air-fuel ratio learning value KG to a predetermined basic value, after the maximum or minimum limit of the air-fuel ratio learning value KG changes.

Figure 4:
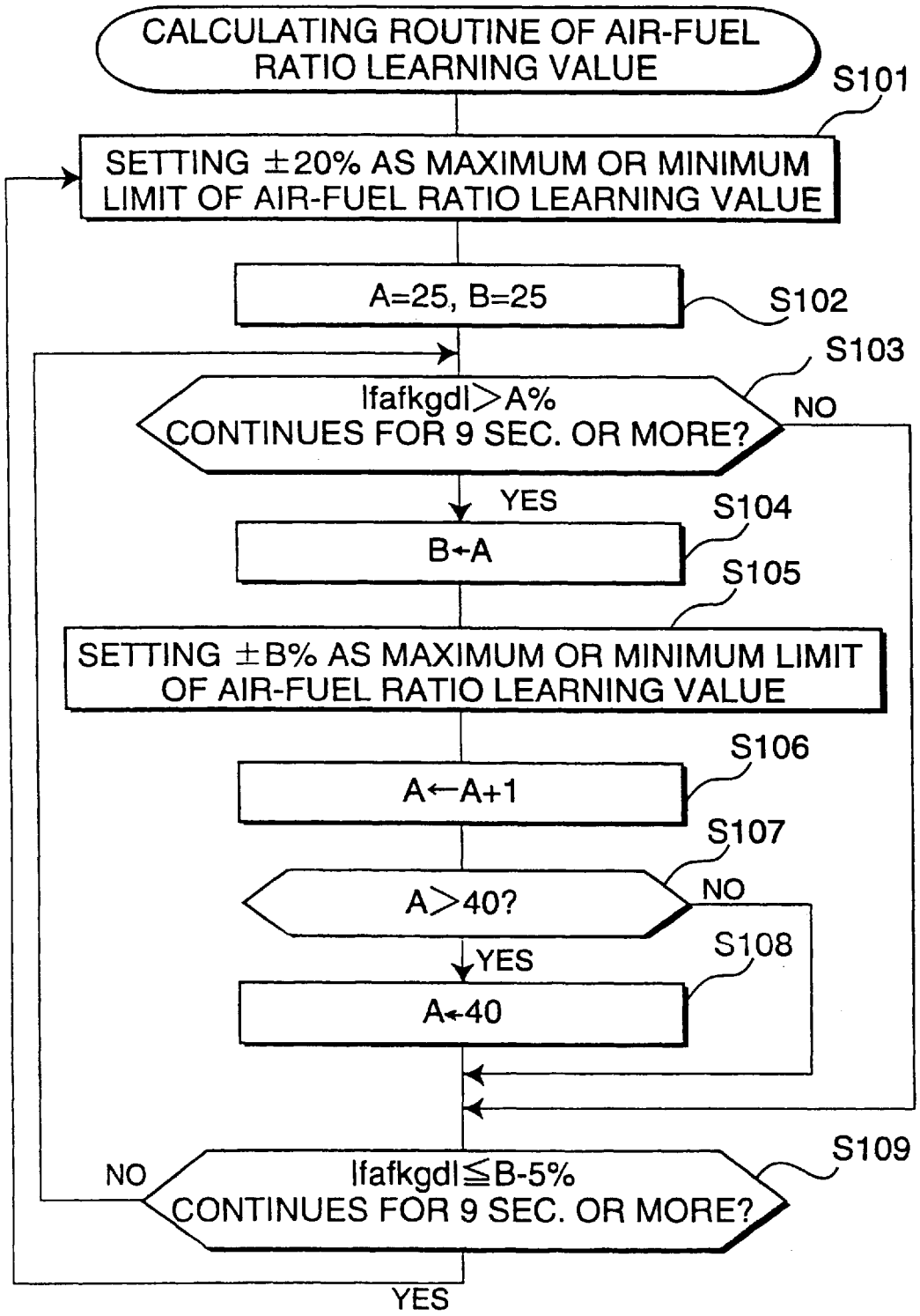
FIG. 4 is a flowchart which shows a routine for calculating an air-fuel ratio learning value of the air-fuel ratio control apparatus as the first embodiment.

In FIG. 4 a flowchart which realizes the maximum and minimum magnifying means and the maximum and minimum returning means is shown in detail. The flowchart shows a calculating routine of the air-fuel ratio learning value KG of the apparatus for controlling the air-fuel ratio in the internal combustion engine 9, as the first embodiment of the present invention.

After the routine starts, ±20% is set as the maximum or minimum limit of the air-fuel ratio learning value KG in step 101 (hereinafter S101 is used, and same to other steps).

Next, A and B are set to 25 in S102.

Next, whether a condition of |fafkgd |>A% continues for 9 seconds or more is determined in query step S103. Here, a smoothed value of (the air-fuel ratio feedback correction value FAF+the air-fuel ratio learning value KG) is fafkgd, and A% is a value by which whether the fuel injection system is abnormal or not is determined. When "no" is determined, the routine jumps to S109. On the other hand, when "yes" is determined, the control proceeds to S104. B is set to A in S104.

Next, ±B% is set for the maximum or minimum limit of the air-fuel ratio learning value KG, and the step transitions to S106. In S106 a revised number which is added 1 to A is set for A.

Next, whether A is greater than 40 or not is determined in S107. When "no" is determined, the step jumps to S109, skipping S108. When "yes" is determined, A is set to 40 in S108.

In S109, whether a condition of |fafkgd |≦(B−5)% continues for 9 seconds or more is determined. When "no" is determined, the control goes to S103. When "yes" is determined, the step returns back to S101.

As mentioned above from S101 to S108, the maximum and minimum magnifying means is realized. Since the maximum or minimum limit of the air-fuel ratio learning value KG is changed by stepping degrees in response to a deviation of fuel injection amount from a fuel injection amount requested for maintaining the target air-fuel ratio, after the air-fuel ratio learning value KG reaches the maximum or minimum limit, a deviation which can not be absorbed by changing the air-fuel ratio learning value KG can be eliminated in a low coolant temperature or after a fuel-cut condition in a deceleration of the vehicle (in these condition the feedback circuit is open and the air-fuel ratio feedback correction value FAF is ±0%). Consequently, a good emission condition (that is, an amount of CO, HC, NOx, or etc. in the exhausted gas is less) is obtained.

Since the maximum and minimum magnifying means can set a middle value of the air-fuel ratio feedback correction values FAF to near 0, the emission amount can be smoothly and without an irregular point maintained less, irrespective of the deviation of the fuel injection amount.

Figure 5:
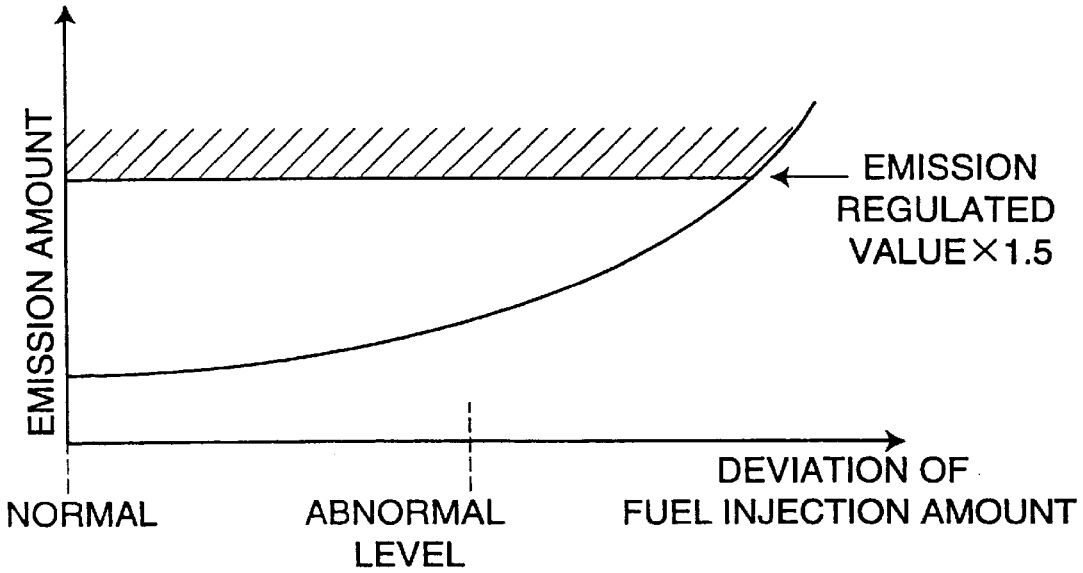
FIG. 5 is a graph showing a relationship between a deviation of a fuel injection amount and an emission amount controlled by the air-fuel ratio control apparatus of the first embodiment shown in FIG. 4.

As illustrated in FIG. 5, the emission amount gradually increases according to the increasing deviation of the fuel injection amount, and the emission amount is not reversed against to the deviation of the fuel injection amount. Here, FIG. 5 shows a relationship between the deviation of a fuel injection amount and the emission amount controlled by the air-fuel ratio control apparatus of the first embodiment.

By S109 the maximum and minimum returning means is realized. When it is not necessary to use the changed maximum or minimum limit, the maximum or minimum limit is returned to the original basic value, because increasing the maximum or decreasing the minimum limit has a possibility of temporarily setting an incorrect air-fuel ratio learning value KG. Such a risk can be minimized by returning the maximum or minimum limit of the air-fuel ratio learning value KG to the basic value.

In the control of the maximum and minimum returning means as mentioned above, the increased maximum or decreased minimum limit of the air-fuel ratio learning value KG is returned to the original basic value, when the condition continues for the predetermined time.

It is, however, also available that the increased maximum or decreased minimum limit of the air-fuel ratio learning value KG is returned to the previous maximum or minimum limit, not to the original basic value, when the condition continues for the predetermined time.

Figure 6:
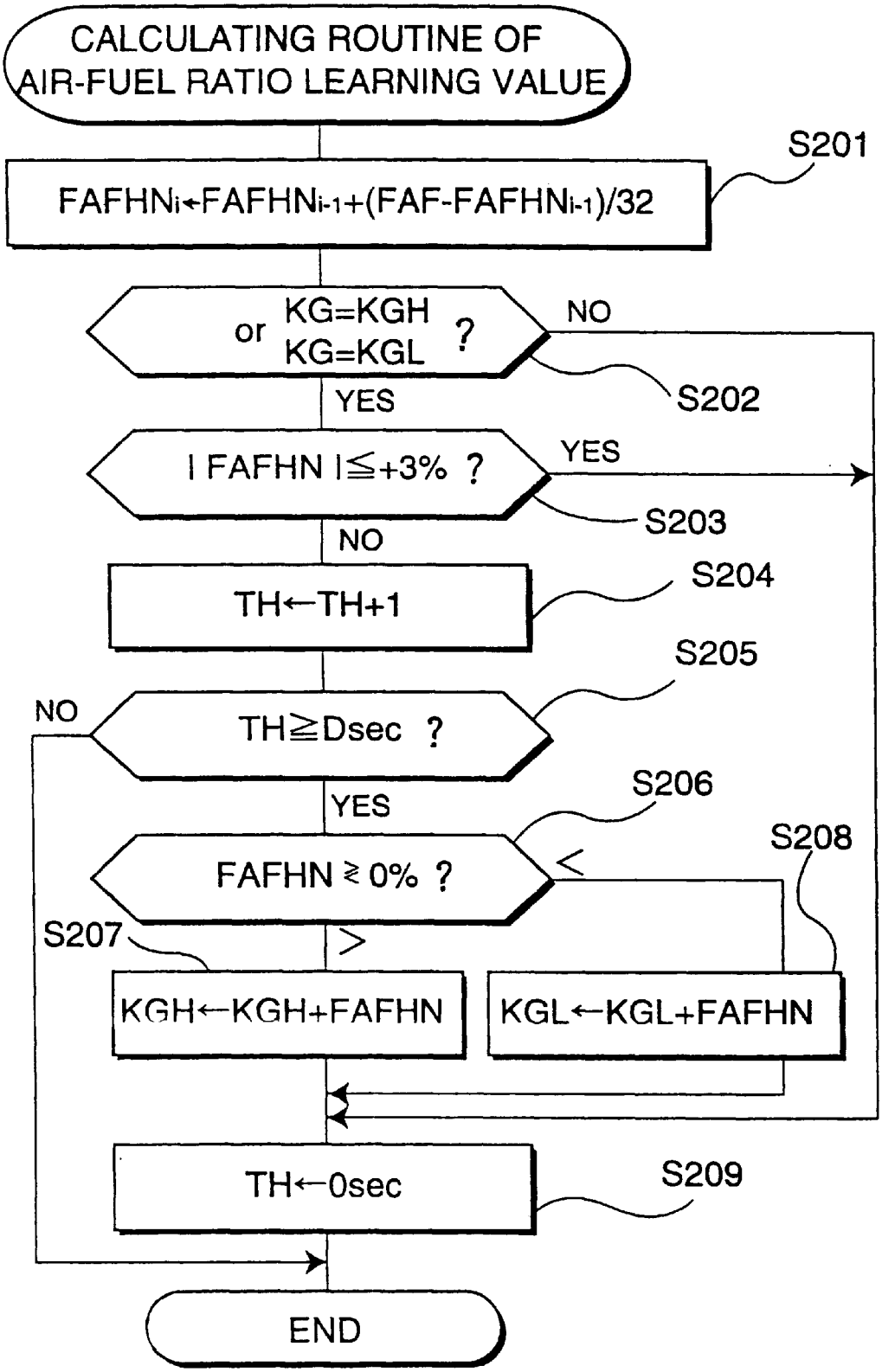
FIG. 6 is a flowchart which shows a routine for calculating an air-fuel ratio learning value of an air-fuel ratio control apparatus as a second embodiment of the present invention.

A flowchart for realizing another type of a maximum and minimum magnifying means is explained using FIG. 6. The flowchart in FIG. 6 shows a calculating routine of the air-fuel ratio learning value of the apparatus for controlling the air-fuel ratio in the internal combustion engine 9 as a second embodiment of the present invention.

As shown in FIG. 6, after starting the routine, $FAFHN_i$ is calculated by adding $(FAF\text{-}FAFHN_{i-1})/32$ to $FAFHN_{i-1}$ in S201. FAF is, here, an air-fuel ratio feedback correction value, and FAFHN is a smoothed value of the air-fuel ratio feedback correction value FAF.

In query step S202, whether KG is equal to KGH or KGL, or not, is determined. (cf. KG is an air-fuel ratio learning value.) KGH is a maximum limit of the air-fuel ratio learning value KG, and KGL is a minimum limit of the air-fuel ratio learning value KG. When "no" is determined, the step jumps to S209. When "yes" is determined, the routine proceeds to S203.

In S203 whether |FAFHN| is equal to or less than 3% is determined. When "no" is determined, the step proceeds to S204. When "yes", the step jumps to S209.

In S204, TH is set to (TH+1). Incidentally, TH is a number which means a time while FAFHN (the smoothed value of the air-fuel ratio feedback correction value FAF) is over a predetermined value.

In S205, whether TH is equal to or longer than D seconds is determined. When "no" is determined, the routine jumps to END. When "yes" is determined on the other hand, the step proceeds to S206. Incidentally, D is a predetermined time.

Next, whether FAFHN is greater or less than 0% is determined in S206. When FAFHN is greater than 0%, the step proceeds to S207. When FAFHN is less than 0%, the step proceeds to S208. In S207, KGH is set to a value which is added FAFHN to KGH, and the control goes to S209. In S208, KGL is set to (KGL+FAFHN), and the control proceeds to S209.

TH is set to 0 second in S209, and finally the routine proceeds to END.

By the executions from S201 to S209 as mentioned above, the maximum and minimum magnifying means can be realized in the second embodiment. When a condition of

|a smoothed value of the air-fuel ratio feedback correction value|>|a predetermined value| continues for a predetermined time, if the smoothed value of the air-fuel ratio feedback value>0 the maximum and minimum magnifying means increases the maximum limit of the air-fuel ratio learning value KG by the smoothed value, and if the smoothed value of the air-fuel ratio feedback value≦0 the maximum and minimum magnifying means decreases the minimum limit of the air-fuel ratio learning value KG by the smoothed value. Consequently, a deviation which can not be absorbed by the air-fuel ratio learning value KG is eliminated in the case where the feedback circuit is open (FAF=±0%), namely in the low coolant temperature or in the fuel-cut condition in the deceleration of the vehicle. Accordingly, a good emission condition (that is, a small amount of CO, HC, NOx, or etc.) can be obtained.

Furthermore, the deviation which can not be absorbed by the air-fuel ratio learning value KG is measured by FAFHN (the smoothed value of the air-fuel ratio feedback value FAF). If FAFHN is greater than a predetermined value (ex. 3%) for D seconds or longer, the maximum or minimum limit of the air-fuel ratio learning value KG is changed by FAFHN. A temporary incorrect air-fuel ratio learning value of the air-fuel ratio control resulting from a temporary deviation from the target air-fuel ratio can then be avoided, and the air-fuel ratio control can be precisely corrected necessarily and sufficiently.

Figure 7:
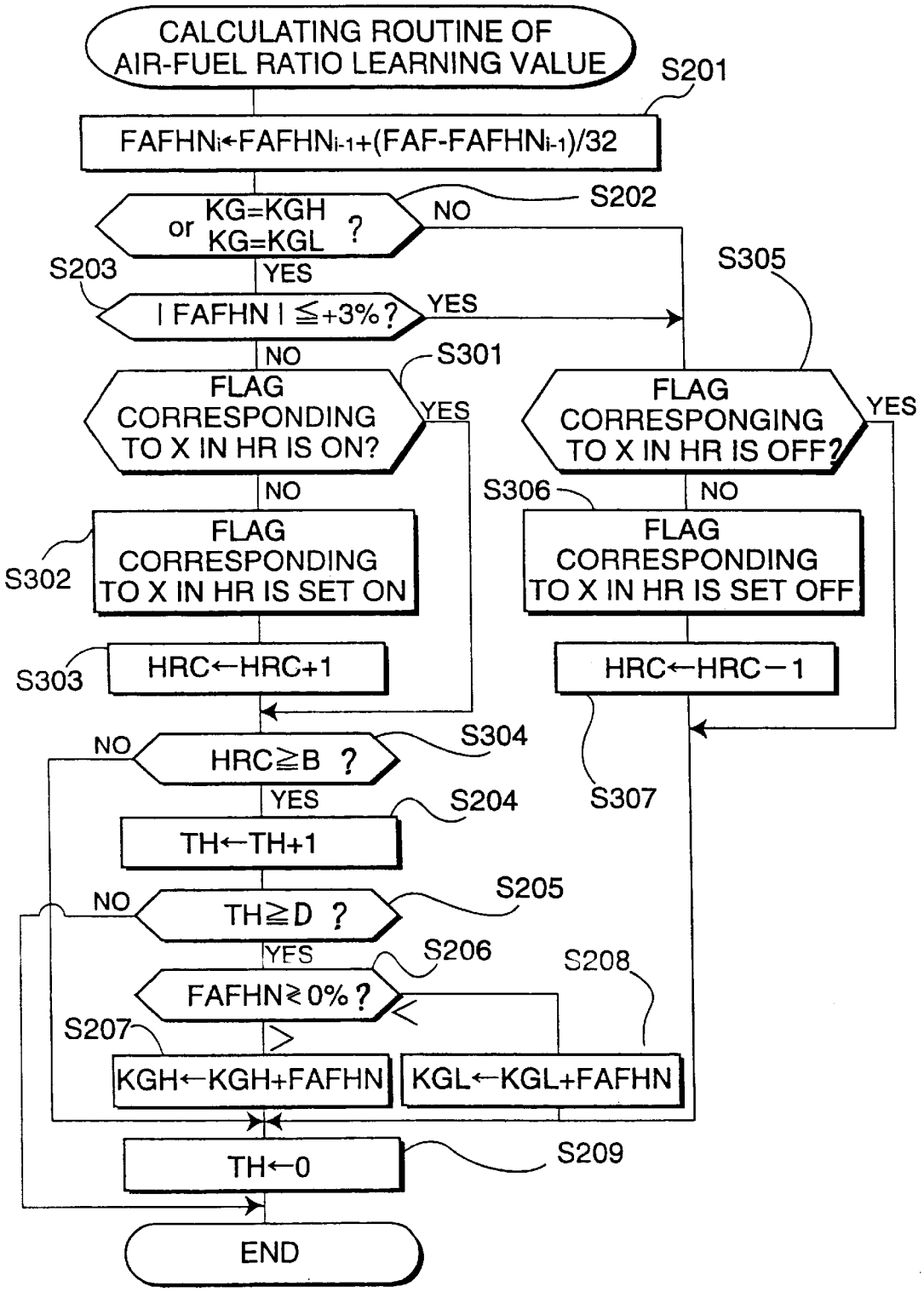
FIG. 7 is a flowchart which shows a routine for calculating an air-fuel ratio learning value of an air-fuel ratio control apparatus as a third embodiment of the present invention.
Figure 8:
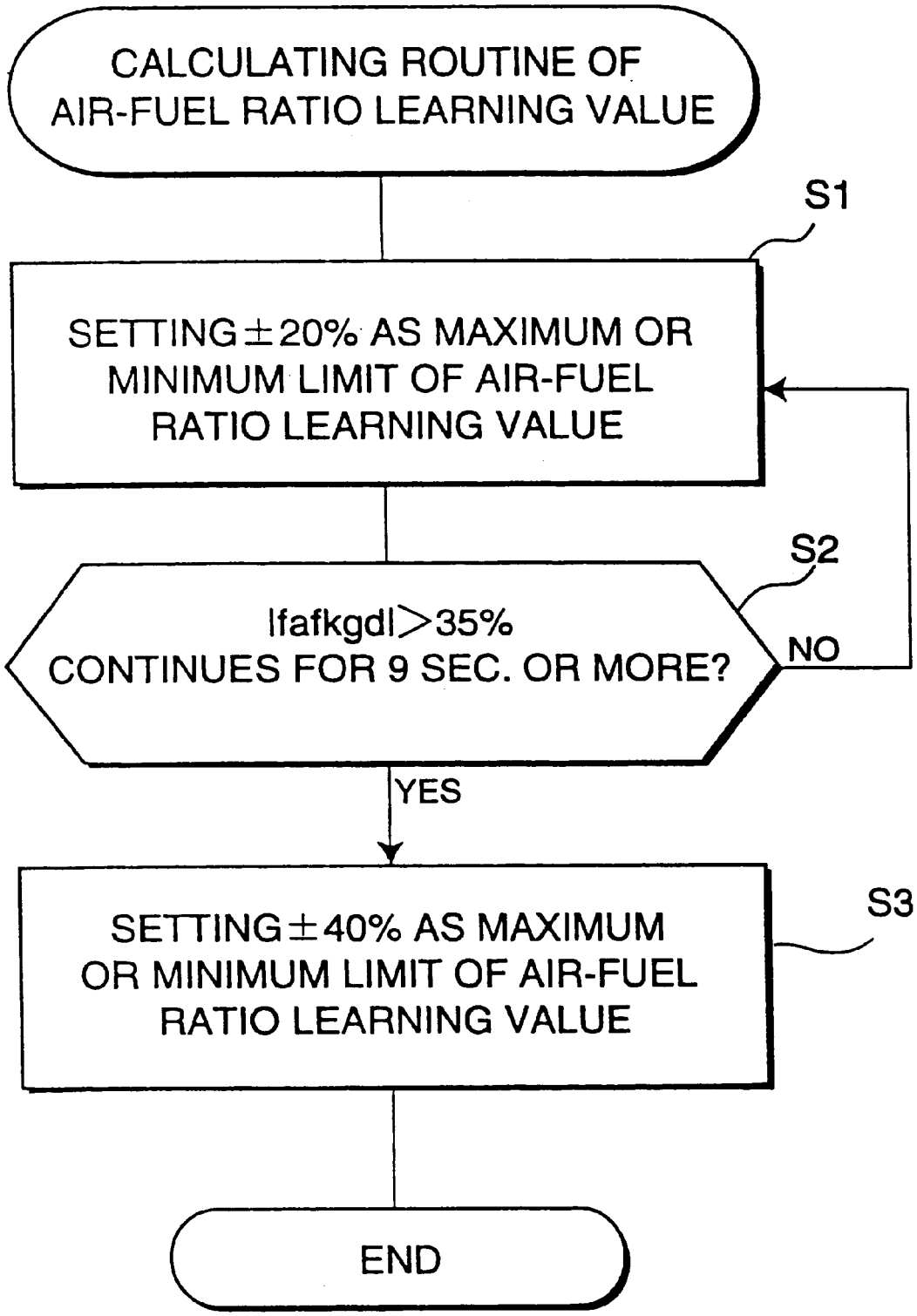
FIG. 8 is a flowchart which shows a known routine for calculating an air-fuel ratio learning value of an air-fuel ratio control apparatus.
Figure 9:
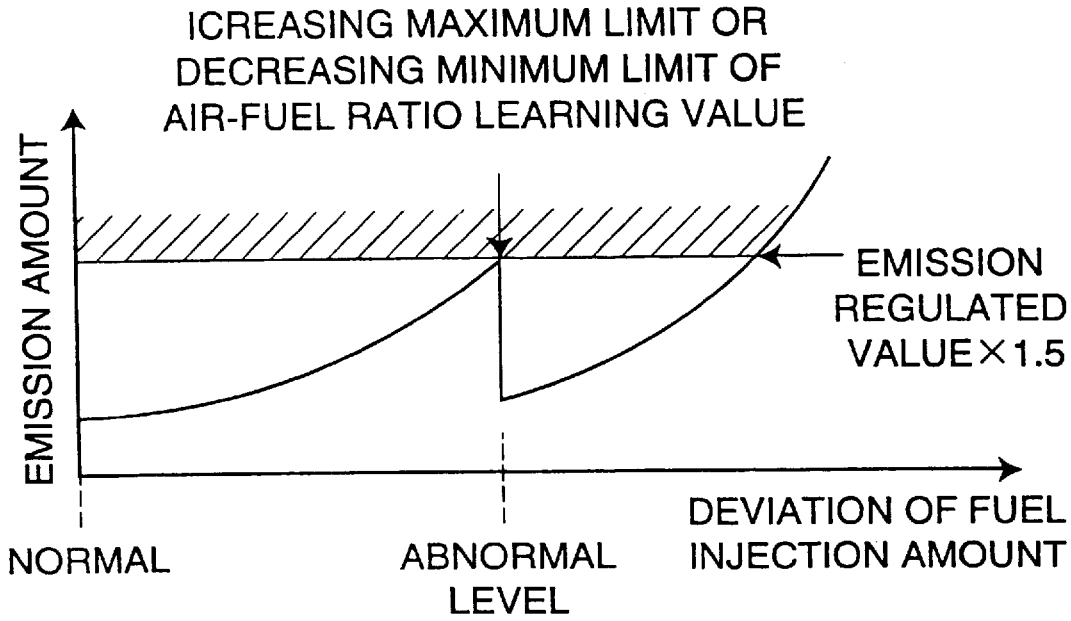
FIG. 9 is a graph showing a known relationship between a deviation of a fuel injection amount and an emission amount controlled by the air-fuel ratio control apparatus.
Figure 10:
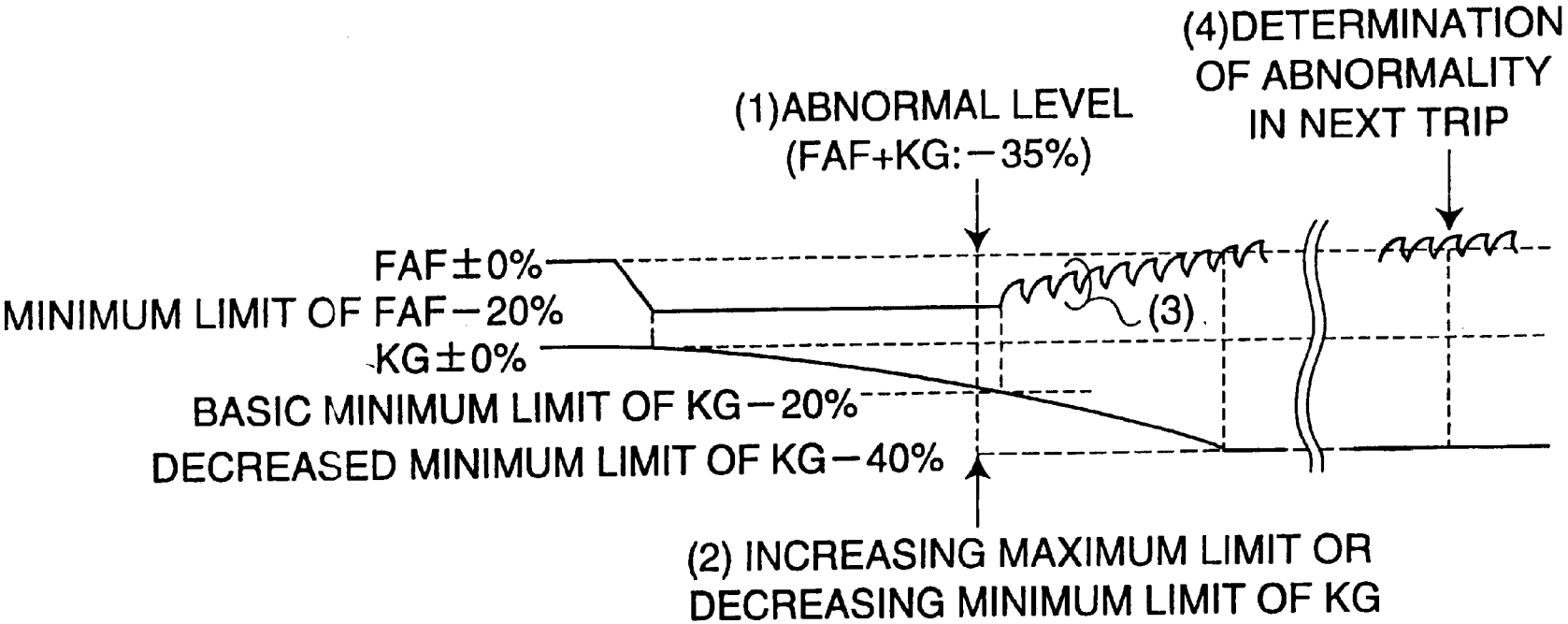
FIG. 10 is a graph showing known transitions of an air-fuel ratio feedback correction value and an air-fuel ratio learning value in the case where a fuel injection correction value is −40%.
Figure 11:
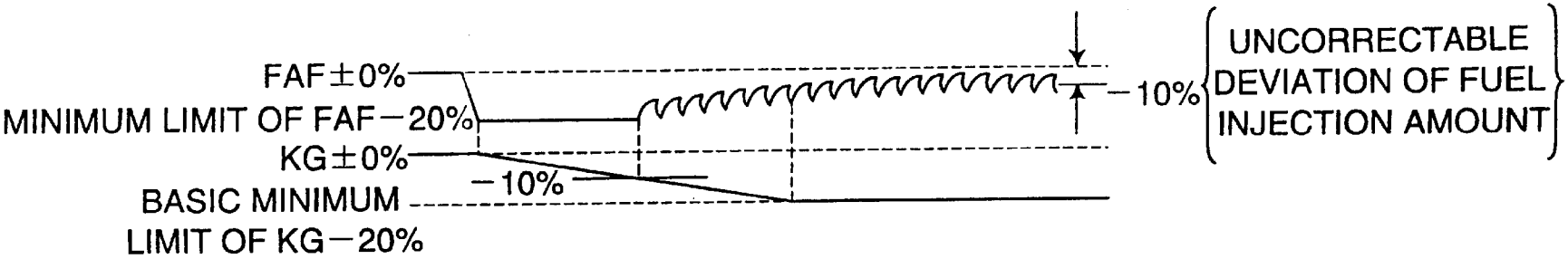
FIG. 11 is a graph showing known transitions of an air-fuel ratio feedback correction value and an air-fuel ratio learning value in the case where the fuel injection correction value is −30%.

Next, the flowchart in FIG. 7 shows a calculating routine of the air-fuel ratio learning value of an apparatus for the air-fuel ratio in the internal combustion engine 9 as a third embodiment of the present invention. The flowchart shown in FIG. 6 is also used in the flowchart of FIG. 7, and some steps are added. Accordingly, the same step numbers as in FIG. 6 are used in FIG. 7 (from S201 to S209) in the same steps, and the explanation of the same steps is here omitted. The added steps (from S301 to S307) are explained.

When "no" is determined in S203, the control proceeds to S301. Whether a flag corresponding to X in HR is ON or not is determined. X is, here, an identifier (0~location count+1) which shows a current learning location, and HR is a configuration of flags which shows the learning locations where the air-fuel ratio learning value KG reaches the maximum or minimum limit. When "no" is determined, the control goes to S302, and when "yes" is determined the control jumps to S304. Incidentally, the learning location indicates a location of a driving condition of the engine 9, which is divided from a view point of an intake air flow amount of the engine 9. The above-mentioned air-fuel ratio learning value is calculated in each learning location.

In S302, a flag corresponding to X in HR is set ON. Next, the control proceeds to S303.

In S303, HRC is set to (HRC+1). HRC, here, shows a count of the learning locations where the air-fuel ratio learning value KG reaches the maximum or minimum limit of the air-fuel ratio learning value KG. Next, the control goes to S304.

In S304, whether HRC is equal to or greater than B is determined. B is a predetermined constant which is used to determine a condition of the learning locations. When "yes" is determined, the control transitions to S204. When "no" is determined, the control jumps to S209.

In the case of "no" in S202 or "yes" in S203, the routine goes to S305. In query step S305 whether a flag corresponding to X in HR is OFF or not is determined. When "no" is determined in S305, the control goes to S306. On the other hand, when "yes" is determined, the control jumps to S209.

In S306, the flag corresponding to X in HR is set OFF. Next, the control goes to S307. In S307, HRC is set to (HRC−1). Next, the control goes to S209.

As mentioned above, in the steps from S301 to S307, a condition whether the air-fuel ratio learning value KG in a plurality of the learning locations divided by a load rate of the engine 9 reaches the maximum or minimum limit is furthermore added to a condition whether the maximum and minimum of the air-fuel ratio learning value KG is changed or not. By adding the aforementioned condition, a temporary incorrect air-fuel ratio learning value due to a deviation of the air-fuel ratio in a part of the learning locations can be avoided. That is, a frequency of incorrect air-fuel ratio learning values can be less by determining in all learning locations, not by determining in a single learning location. Incidentally, the above-mentioned load rate of the engine 9 is a ratio of intake air mass per a revolution against a supposition mass per a revolution. The intake air mass is measured by the air flow meter 2. The supposition mass is calculated by supposing that the new intake air fully occupies the piston stroke of the engine 9 in the standard atmosphere. The load rate is substantially equal to a charging rate of intake air in a cylinder of the engine 9.

Figure 12:
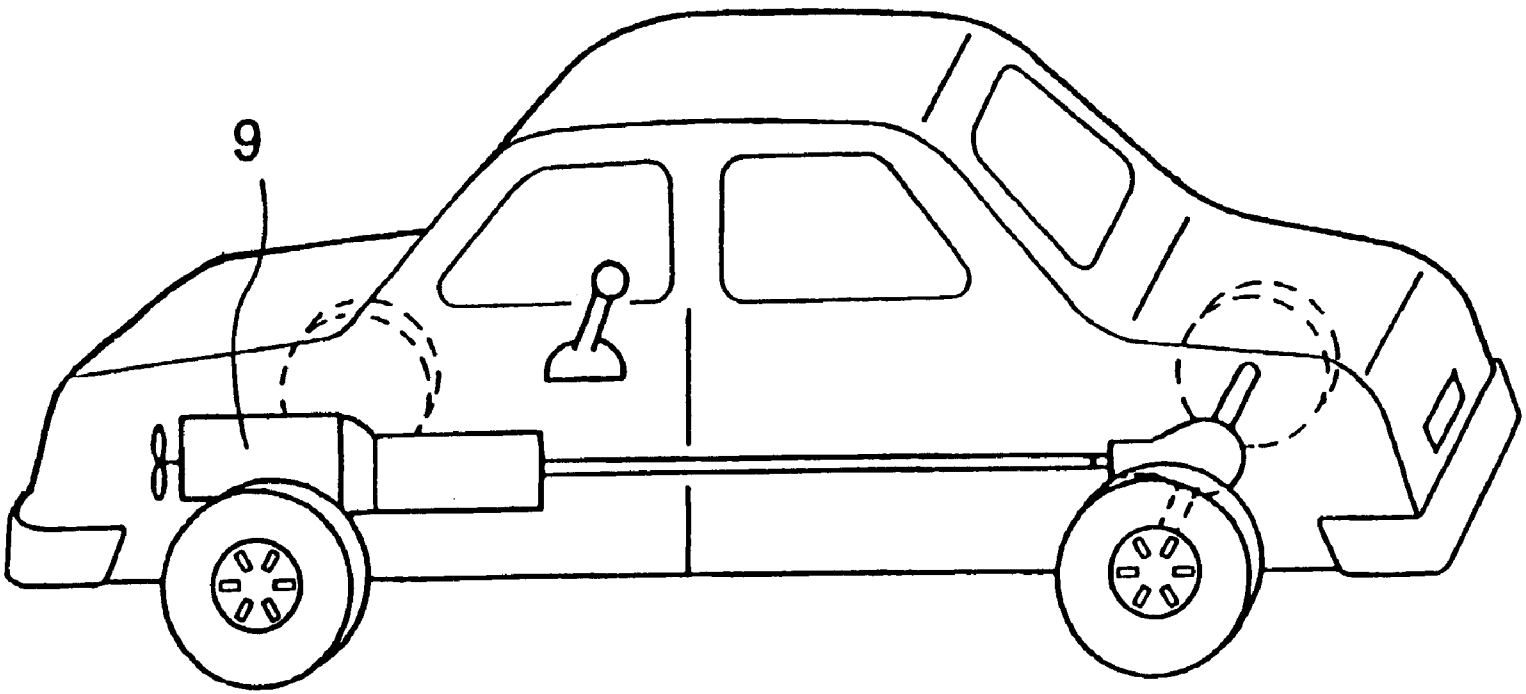
FIG. 12 is a schematic view of a vehicle in which the internal combustion engine having the air-fuel ratio control apparatus is mounted.

A vehicle which comprises the internal combustion engine 9 is shown in FIG. 12.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. An apparatus for controlling an air-fuel ratio in an internal combustion engine comprising:

an oxygen sensor in an exhaust passage of the internal combustion engine for detecting a concentration of oxygen in exhaust gas from said internal combustion engine;

a first operational means for calculating an air-fuel ratio feedback correction value based on a value outputted by said oxygen sensor so that an actual air-fuel ratio in said internal combustion engine is equal to a target air-fuel ratio;

a second operational means for calculating an air-fuel ratio learning value so that the air-fuel ratio feedback correction value is within a predetermined range, the air-fuel ratio learning value being different from the air-fuel ratio feedback correction value;

a maximum and minimum setting means for setting a maximum limit and a minimum limit of the air-fuel ratio learning value;

an air-fuel ratio correcting means for correcting a fuel injection time of a fuel injection valve in an intake passage of said internal combustion engine based on the air-fuel ratio feedback correction value calculated by said first operational means and the air-fuel ratio learning value calculated by said second operational means; and a maximum and minimum magnifying means for increasing the maximum or decreasing the minimum limit of the air-fuel ratio learning value by stepping degrees in response to a deviation of fuel injection amount, injected by the fuel injection valve, from a fuel injection amount requested for maintaining the target air-fuel ratio after the air-fuel ratio learning value reaches the maximum or minimum limit.

2. An internal combustion engine comprising the apparatus for controlling the air-fuel ratio as set forth in claim 1.

3. A vehicle comprising the internal combustion engine as set forth in claim 2.

4. The apparatus for controlling the air-fuel ratio as set forth in claim 1, wherein said maximum and minimum magnifying means increases the maximum or decreases the minimum limit of the air-fuel ratio learning value by stepping predetermined degrees when a condition of

|a smoothed value of (the air-fuel ratio feedback correction value+ the air-fuel ratio learning value)|>|(the maximum or minimum limit of the air-fuel ratio learning value)+a predetermined value| continues for a predetermined time after the air-fuel ratio learning value reaches the maximum or minimum limit.

5. The apparatus for controlling the air-fuel ratio as set forth in claim 4, wherein the increased maximum and decreased minimum limits of the air-fuel ratio learning value are restrained within predetermined upper and lower values.

6. The apparatus for controlling the air-fuel ratio as set forth in claim 4, further comprising a maximum and minimum returning means for returning the maximum or minimum limit of the air-fuel ratio learning value magnified by said maximum and minimum magnifying means to the previous maximum or minimum limit of the air-fuel ratio learning value when a condition of

|a smoothed value of (the air-fuel ratio feedback correction value+ the air-fuel ratio learning value)|≦|(the magnified maximum or minimum limit of the air-fuel ratio learning value)−a predetermined value| continues for a predetermined time.

7. The apparatus for controlling the air-fuel ratio as set forth in claim 1, further comprising a maximum and minimum returning means for returning the magnified maximum or minimum limit of the air-fuel ratio learning value by said maximum and minimum magnifying means to a predetermined basic maximum or minimum limit of the air-fuel ratio learning value when a condition of

|a smoothed value of (the air-fuel ratio feedback correction value+ the air-fuel ratio learning value)|≦|(the magnified maximum or minimum limit of the air-fuel ratio learning value)−a predetermined value| continues for a predetermined time.

8. The apparatus for controlling the air-fuel ratio as set forth in claim 1, further comprising a maximum and minimum returning means for decreasing the magnified maximum limit of the air-fuel ratio learning value by a predetermined value or increasing the magnified minimum limit of the air-fuel ratio learning value by a predetermined value when a condition of

|a smoothed value of (the air-fuel ratio feedback correction value+ the air-fuel ratio learning value)|≦|(the magnified maximum or minimum limit of the air-fuel ratio learning value)−a predetermined value| continues for a predetermined time.

9. The apparatus for controlling the air-fuel ratio as set forth in claim 1, wherein when a condition of

|a smoothed value of the air-fuel ratio feedback correction value|>|a predetermined value|continues for a predetermined time:

if the smoothed value of the air-fuel ratio feedback value>0 said maximum and minimum magnifying means increases the maximum limit of the air-fuel ratio learning value by the smoothed value; and if the smoothed value of the air-fuel ratio feedback value≦0 said maximum and minimum magnifying means decreases the minimum limit of the air-fuel ratio learning value by the smoothed value.

10. The apparatus for controlling the air-fuel ratio as set forth in claim 1, wherein said maximum and minimum magnifying means increases the maximum or decreases the minimum limit of the air-fuel ratio learning value in response to a deviation of the air-fuel injection amount when the actual air-fuel injection amount is deviated from a requested fuel injection amount for maintaining the target air-fuel ratio after a plurality of the air-fuel ratio learning values in a plurality of learning locations reach the maximum or minimum limit of the air-fuel ratio learning value.

11. A method for controlling an air-fuel ratio in an internal combustion engine having a fuel injection valve in an intake passage of the internal combustion engine and an oxygen sensor in an exhaust passage of the internal combustion engine, comprising the steps of:

detecting a concentration of oxygen in exhaust gas from the internal combustion engine;

calculating an air-fuel ratio feedback correction value based on the concentration of oxygen so that an actual air-fuel ratio in the internal combustion engine is equal to a target air-fuel ratio;

calculating an air-fuel ratio learning value so that the air-fuel ratio feedback correction value is within a predetermined range, the air-fuel ratio learning value being different from the air-fuel ratio feedback correction value;

setting a maximum limit and a minimum limit of the air-fuel ratio learning value;

correcting a fuel injection time of said fuel injection valve based on the air-fuel ratio feedback correction value and the air-fuel ratio learning value; and increasing the maximum or decreasing the minimum limit of the air-fuel ratio learning value by stepping degrees in response to a deviation of fuel injection amount, injected by the fuel injection valve from fuel injection amount requested for maintaining the target air-fuel ratio after the air-fuel ratio learning value reaches the maximum or minimum limit.

12. The method as set forth in claim 11, wherein said magnifying step comprises the steps of:

determining whether the air-fuel ratio learning value reaches the maximum or minimum limit or not;

determining whether a condition

|a smoothed value of (the air-fuel ratio feedback correction value+the air-fuel ratio learning value)|>|(the maximum or minimum limit of the air-fuel ratio learning value)+a predetermined value| continues for a predetermined time;

increasing the maximum or decreasing the minimum limit of the air-fuel ratio learning value by stepping predetermined degrees.

13. The method as set forth in claim 12, further comprising the steps:

determining whether a condition of

|a smoothed value of (the air-fuel ratio feedback correction value+the air-fuel ratio learning value)|≦|(the magnified maximum or minimum limit of the air-fuel ratio learning value)−a predetermined value| continues for a predetermined time or not; and returning the increased maximum or decreased minimum limit of the air-fuel ratio learning value to the previous maximum or minimum limit of the air-fuel ratio learning value.

14. The method as set forth in claim 12, further comprising the steps:

determining whether a condition of

|a smoothed value of (the air-fuel ratio feedback correction value+the air-fuel ratio learning value)|≦|(the magnified maximum or minimum limit of the air-fuel ratio learning value)−a predetermined value| continues for a predetermined time or not; and returning the increased maximum or decreased minimum limit of the air-fuel ratio learning value to a predetermined basic maximum or minimum limit of the air-fuel ratio learning value.

15. The method as set forth in claim 12, further comprising the steps:

determining whether a condition of

|a smoothed value of (the air-fuel ratio feedback correction value+the air-fuel ratio learning value)|≦|(the magnified maximum or minimum limit of the air-fuel fuel ratio learning value)=a predetermined value| continues for a predetermined time or not; and decreasing the increased maximum limit of the air-fuel ratio learning value by a predetermined value or increasing the decreased minimum limit of the air-fuel ratio learning value by a predetermined value.

16. The method as set forth in claim 11, wherein said magnifying step comprises the steps of:

determining whether the air-fuel ratio learning value reaches the maximum or minimum limit or not;

determining whether

|a smoothed value of the air-fuel ratio feedback correction value|>|a predetermined value| continues for a predetermined time or not;

determining whether the smoothed value of the air-fuel ratio feedback value>0 or not;

increasing the maximum limit of the air-fuel ratio learning value by the smoothed value if the smoothed value of the air-fuel ratio feedback value>0; and decreasing the minimum limit of the air-fuel ratio learning value by the smoothed value if the smoothed value of the air-fuel ratio feedback value≦0.

17. The method as set forth in claim 11, wherein said magnifying step comprises the steps of:

determining whether the air-fuel ratio learning value reaches the maximum or minimum limit or not;

determining whether the actual air-fuel injection amount is deviated or not; and increasing the maximum or decreasing the minimum limit of the air-fuel ratio learning value in response to a deviation of the air-fuel injection amount.

* * * * *